US011486644B1

(12) United States Patent
Salcedo et al.

(10) Patent No.: US 11,486,644 B1
(45) Date of Patent: Nov. 1, 2022

(54) MICROPROCESSOR-BASED CONTROLLER FOR PELLET BURNERS

(71) Applicants: Richard Salcedo, Fairfield, CA (US); Albert Salcedo, Modesto, CA (US)

(72) Inventors: Richard Salcedo, Fairfield, CA (US); Albert Salcedo, Modesto, CA (US)

( * ) Notice: Subject to any disclaimer, the term of this patent is extended or adjusted under 35 U.S.C. 154(b) by 65 days.

(21) Appl. No.: 17/110,178

(22) Filed: Dec. 2, 2020

(51) Int. Cl.
*F27D 19/00* (2006.01)
*F27D 21/00* (2006.01)

(52) U.S. Cl.
CPC ..... *F27D 19/00* (2013.01); *F27D 21/0014* (2013.01); *F27D 2019/004* (2013.01); *F27D 2019/0093* (2013.01); *F27D 2021/0071* (2013.01)

(58) Field of Classification Search
CPC ..... F27D 19/00; F27D 21/0014; F27D 2019/004; F27D 2019/0093; F27D 2021/0071
See application file for complete search history.

(56) References Cited

U.S. PATENT DOCUMENTS

| | | | | |
|---|---|---|---|---|
| 5,873,356 | A * | 2/1999 | Vossler | F23N 1/062 110/211 |
| 10,139,166 | B2 | 11/2018 | Hallowell et al. | |
| 10,429,297 | B2 | 10/2019 | Putaansuu | |
| 2019/0069721 | A1 | 3/2019 | Walters et al. | |

* cited by examiner

*Primary Examiner* — Scott R Kastler
(74) *Attorney, Agent, or Firm* — Plager Schack LLP; Mark H. Plager; Stephen Hallberg

(57) ABSTRACT

A microprocessor-based controller for pellet burners is disclosed that provides a level of safety and reliability to any pellet burner by implementing a feed forward control scheme using sensor detected information in a formula to determine proper processing results, utilizing feedback for proper combustion, such that temperature is effectively controlled, thereby greatly reducing the chance of a fire or an explosion.

9 Claims, 2 Drawing Sheets

MICROPROCESSOR-BASED CONTROLLER FOR PELLET BURNERS

BACKGROUND

Embodiments of the invention described in this specification relate generally to automated control systems, and more particularly, to a microprocessor-based controller for pellet burners and a microprocessor-based temperature control process for controlling combustion in pellet burners that provide a level of safety and reliability to any pellet burner by implementing a feed forward control scheme using sensor detected information in a formula to determine proper processing results, utilizing feedback for proper combustion, such that temperature is effectively controlled, thereby greatly reducing the chance of a fire or an explosion.

Currently most existing conventional wood pellet burning systems have trouble controlling temperature and flame stability. This has caused fires and explosions of pellet burning systems. Specifically, the existing conventional pellet burning systems just use temperature and time constants. Using temperature and a time control approach has led to fires and explosions that are well documented with consumer reports and internet videos and blogs.

Other devices and systems do not properly control combustion. Most use a temperature control approach. This also has led to fires and explosions documented on the internet and consumer reports. Thus, the problem remains the inability of conventional pellet burning systems and other devices or systems to control temperature, which severely increases the possibility of furnace explosions and fires.

Therefore, what is needed is a way to implement or provide a feed forward control scheme using a formula to determine proper process results, utilizing feedback for proper combustion, whereby temperature can be controlled resulting in greatly reducing the chance of a fire or an explosion.

BRIEF DESCRIPTION

A novel microprocessor-based controller for pellet burners and a microprocessor-based temperature control process for controlling combustion in pellet burners are disclosed. The microprocessor-based controller for pellet burners and the microprocessor-based temperature control process for controlling combustion in pellet burners provide a level of safety and reliability to any existing or new pellet burning system by implementing a feed forward control scheme using sensor detected information in a formula to determine proper processing results, utilizing feedback for proper combustion, such that temperature is effectively controlled, thereby greatly reducing the chance of a fire or an explosion.

The preceding Summary is intended to serve as a brief introduction to some embodiments of the invention. It is not meant to be an introduction or overview of all inventive subject matter disclosed in this specification. The Detailed Description that follows and the Drawings that are referred to in the Detailed Description will further describe the embodiments described in the Summary as well as other embodiments. Accordingly, to understand all the embodiments described by this document, a full review of the Summary, Detailed Description, and Drawings is needed. Moreover, the claimed subject matters are not to be limited by the illustrative details in the Summary, Detailed Description, and Drawings, but rather are to be defined by the appended claims, because the claimed subject matter can be embodied in other specific forms without departing from the spirit of the subject matter.

BRIEF DESCRIPTION OF THE DRAWINGS

Having described the invention in general terms, reference is now made to the accompanying drawings, which are not necessarily drawn to scale, and wherein.

DETAILED DESCRIPTION

Figure 1:
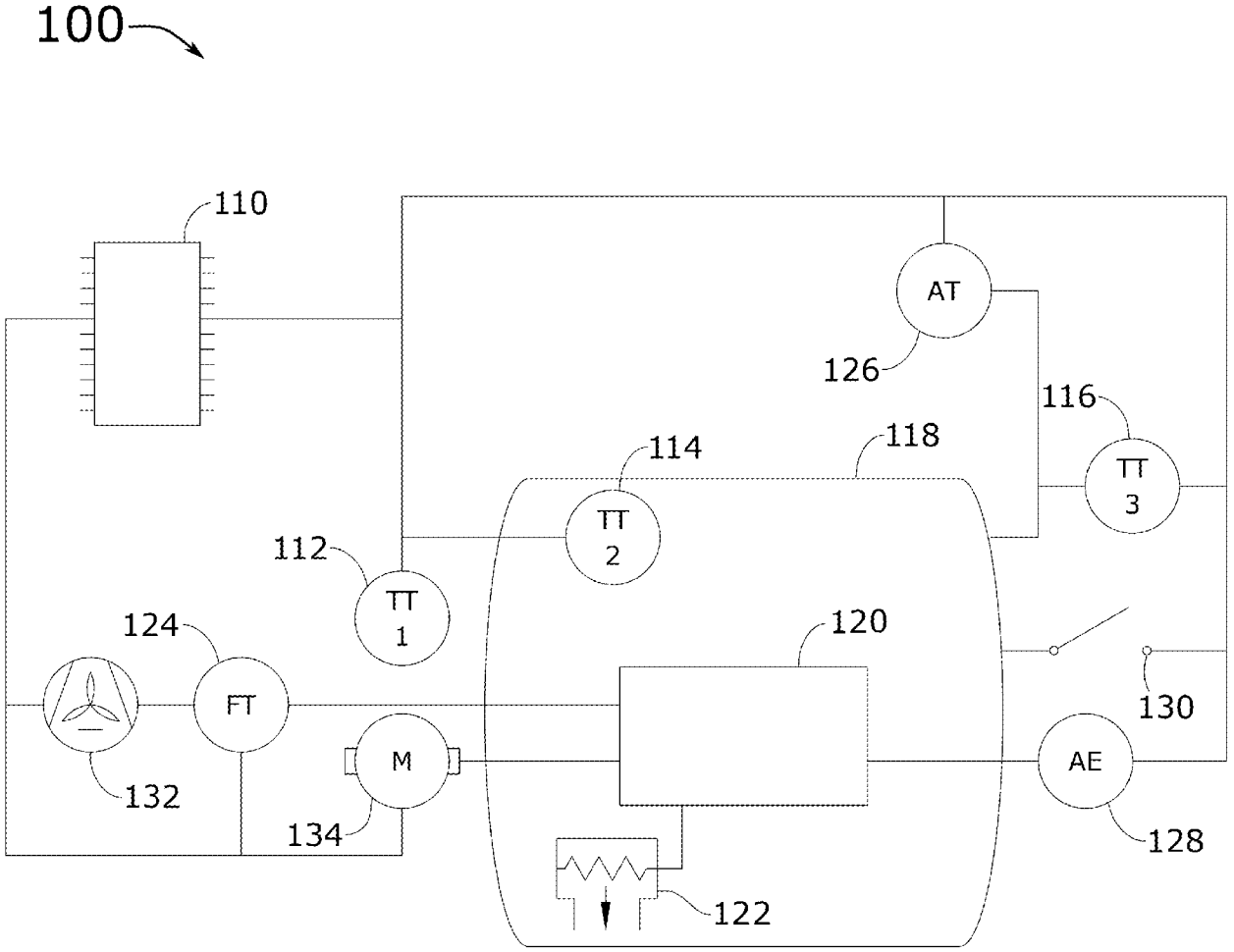
FIG. 1 conceptually illustrates a schematic of a microprocessor-based controller for pellet burners in some embodiments.

In the following detailed description of the invention, numerous details, examples, and embodiments of the microprocessor-based controller for pellet burners and the microprocessor-based temperature control process for controlling combustion in pellet burners are described. However, it will be clear and apparent to one skilled in the art that the invention is not limited to the embodiments set forth and that the invention can be adapted for any of several applications where temperature control is needed, including devices and systems geared for the everyday use, such as barbecues, fire places, water heaters, etc.

In this specification, "ASHRAE" is an acronym for the American Society of Heating, Refrigerating and Air-Conditioning Engineers and is used in connection with the phrase "ASHRAE principles and calculations" or the phrase "basic ASHRAE principles and calculations" or other similar phrases. For purposes of the embodiments described below, ASHRAE principles and calculations are the principles and calculations used in the heating and cooling industry and recognized by the American Society of Heating, Refrigerating and Air-Conditioning Engineers (ASHRAE).

Some embodiments of the invention include a novel microprocessor-based controller for pellet burners and a microprocessor-based temperature control process for controlling combustion in pellet burners. The microprocessor-based controller for pellet burners and the microprocessor-based temperature control process for controlling combustion in pellet burners provide a level of safety and reliability to any existing or new pellet burning system by implementing a feed forward control scheme using sensor detected information in a formula to determine proper processing results, utilizing feedback for proper combustion, such that temperature is effectively controlled, thereby greatly reducing the chance of a fire or an explosion.

As stated above, most existing conventional wood pellet burning systems have trouble controlling temperature and flame stability. This has caused fires and explosions of pellet burning systems. Specifically, the existing conventional pellet burning systems just use temperature and time constants. Using temperature and a time control approach has led to fires and explosions that are well documented with consumer reports and internet videos and blogs. Other devices and systems also do not properly control combustion. Most use a temperature control approach. This also has led to fires and explosions documented on the internet and consumer reports. Thus, the problem remains the inability of conventional pellet burning systems and other devices or systems to control temperature, which severely increases the possibility of furnace explosions and fires. Embodiments of the microprocessor-based controller for pellet burners described in this specification solve such problems by implementing a feed forward control scheme that involves calculation of the required BTUs based off of a delta temperature and air volume, and by utilizing feedback sensors for proper combustion and desired functionality.

Embodiments of the microprocessor-based controller for pellet burners described in this specification differ from and improve upon currently existing options. In particular, some embodiments differ by using a feed forward calculation to control temperature, where known values are used to determine fuel input to achieve the desired process set point.

In addition, some embodiments of the microprocessor-based controller for pellet burners improve upon the currently existing systems and devices which typically utilize a temperature approach, and/or timing control approach, whereby pellets are fed into the burner without feedback of proper combustion. Without contemporaneous feedback, the pellet burning systems are based on assumptions of proper operation. However, if the system dynamics are not working as assumed and expected, unintended results occur, potentially involving furnace explosions and fires. By contrast, the microprocessor-based controller for pellet burners of the present disclosure implements and performs a feed forward control scheme using a formula to determine proper process results and utilizing feedback for proper combustion. In this way, temperature is controlled and the chance of fire or explosion is greatly reduced.

By way of example, FIG. 1 conceptually illustrates a schematic of a microprocessor-based controller for pellet burners 100 in some embodiments. The microprocessor-based controller for pellet burners 100 of the present disclosure may be comprised of the following elements. This list of possible constituent elements is intended to be exemplary only and it is not intended that this list be used to limit the microprocessor-based controller for pellet burners 100 of the present application to just these elements. Persons having ordinary skill in the art relevant to the present disclosure may understand there to be equivalent elements that may be substituted within the present disclosure without changing the essential function or operation of the microprocessor-based controller for pellet burners 100.

1. Microprocessor 110 (or microprocessor/micro-controller 110, which includes wireless connectivity in some deployments and implementations of the microprocessor-based controller for pellet burners 100)
2. Ambient temperature sensor/transmitter 112
3. Furnace temperature sensor/transmitter 114
4. Stack (exhaust) temperature sensor/transmitter 116
5. Furnace 118
6. Pellet box 120 (existing or modified burner)
7. Electric ignitor 122 (existing or modified)
8. Air flow sensor 124 (sensor/transmitter)
9. Opacity meter 126 (or opacity analyzer 126)
10. Flame intensity transmitter 128 (sensor/transmitter)
11. Furnace door switch 130
12. Combustion air fan 132 (DC air fan 300 CFM@0.25)
13. Pellet auger motor 134 (or pellet drive motor, existing or aftermarket)

In some embodiments, the microprocessor-based controller for pellet burners 100 is designed to control a wood pellet burning system that includes a fuel feeding system, a pellet auger motor 134 and ignitor 122, a combustion air fan 132, and/or natural draft air source, and a housing that provides a furnace and flue for the combustion process. To this end, the microprocessor-based controller for pellet burners 100 uses a microprocessor/micro-controller 110 which utilizes inputs and provides outputs.

In some embodiments, three temperature sensors provide feedback of ambient air (the ambient temperature sensor/transmitter 112), furnace (the furnace temperature sensor/transmitter 114), and flue (the stack/exhaust temperature sensor/transmitter 116).

In some embodiments, the air flow sensor 124 is included to detect air flow. In some other embodiments, an algorithm is used to determine air flow, where no air flow sensor is present. In some embodiments, the flame intensity transmitter 128 provides feedback of flame strength in the burner. Some embodiments of the microprocessor-based controller for pellet burners includes an optional opacity meter 126 that can be used as an added element for safety and/or to control desired opacity. In some embodiments, the microprocessor/micro-controller 110 provides output to the system components stated above. Furthermore, a user may interact with and interface with the microprocessor/micro-controller 110 of the microprocessor-based controller for pellet burners via network. Examples of network communication include, without limitation, Intranet, Internet, Bluetooth, WiFi, etc. In some embodiments, the interface includes an application through which the user can provide a desired function in relation to the functions of the pellet burning process, such as furnace and flue temperature.

The microprocessor-based controller for pellet burners 100 of the present disclosure generally works by in a particular way to accurately control temperature of the furnace and or flue temperature. Added control schemes can be implemented as a secondary function, smoke or other.

The user will provide input via network, operator interface, and or a combination of both. The user will interface with the microprocessor/micro-controller 110 to provide desired set points and commands as burner state, furnace and or flue temperature, and opacity (if utilized).

The sensors provide feedback to the controller to determine and track BTUs. There are algorithms that use these sensors to provide a fully metered burner to achieve the desired temperature. The microprocessor/micro-controller 110 determines the state of the burner and provides command and control of the fuel metering system, the air control system, and opacity system (if utilized).

The sensors also provide feedback for the microprocessor/micro-controller 110 to determine proper functionality of the combustion process to ensure that the system is within a "window" of parameters that the microprocessor/micro-controller 110 has programmed and is dynamic throughout the combustion range.

To make the microprocessor-based controller for pellet burners of the present disclosure, a person may use a microprocessor/micro-controller 110 capable of reviving inputs from field sensors connected to a wood pellet burning system, which has a fuel delivery system connected to a pellet auger motor 134, an ignitor 122, and a combustion air fan 132. The microprocessor/micro-controller 110 would need to be programmed to give commands and controls to these systems. As such, the microprocessor/micro-controller 110 would need to be configured to take the user's desired functions and provide the pellet burning system with fuel, and air to preform proper combustion. The subroutines within the microprocessor/micro-controller 110 would be programmed to monitor the inputs to determine proper output for combustion.

To control temperature in the desired process, the desired fuel flow rate is calculated by the microprocessor/micro-controller 110 using the attached sensors. Thus, the person would need to program, implement, or otherwise configure the microprocessor/micro-controller 110 to interact with several sensor/transmitter systems and devices, including, without limitation, an integrated temperature controller with limited influence, which adds or subtracts BTUs based on the set point using a standard proportional integral derivative (PID) algorithm control variable 0-100% (CV). When the required BTUs have been determined, the microprocessor/micro-controller 110 meters in the pellets using time and or a stepper function and/or motor. The metered in pellet fuel is then subtracted as it is used.

In some embodiments, efficiency is to compensate for the unknowns of ambient conditions, when the standard efficiency will not keep the temperature controller at equilibrium using the feed forward calculation, the efficiency will dynamically change to compensate.

Figure 2:
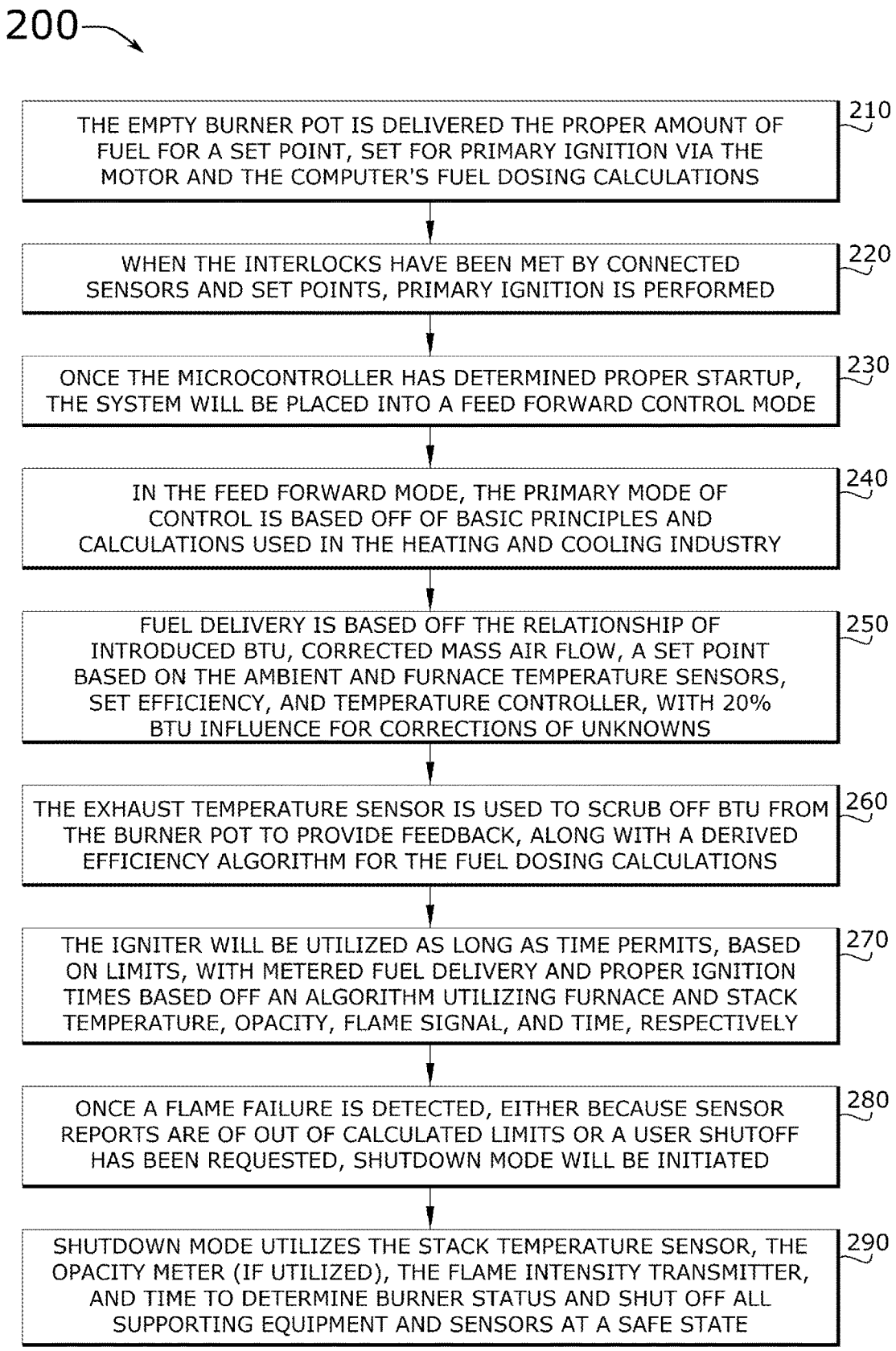
FIG. 2 conceptually illustrates a microprocessor-based temperature control process for controlling combustion in pellet burners in some embodiments.

Turning to another example, FIG. 2 conceptually illustrates a microprocessor-based temperature control process for controlling combustion in pellet burners 200 in some embodiments. As shown in this figure, the microprocessor-based temperature control process for controlling combustion in pellet burners 200 includes a plurality of steps to properly bring a furnace to a particular temperature. Specifically, after proper self-instrumentation calibrations, the following steps are performed by the microprocessor-based temperature control process for controlling combustion in pellet burners 200. At an initial step of the microprocessor-based temperature control process for controlling combustion in pellet burners 200, an empty pellet box 120 will be delivered the proper amount of fuel for a set point, set for primary ignition by way of the pellet auger motor 134 and the computer's fuel dosing calculations (at 210). Next, when interlocks have been met by connected sensors and set points, the microprocessor-based temperature control process for controlling combustion in pellet burners 200 performs primary ignition (at 220). The next step of the microprocessor-based temperature control process for controlling combustion in pellet burners 200 is performed once the microprocessor/micro-controller 110 has determined proper startup, whereby the system is placed into a feed forward control mode (at 230). Proceeding to the next step, the microprocessor-based temperature control process for controlling combustion in pellet burners 200 ensures that when the system is in feed forward mode, the primary mode of control is based off of basic ASHRAE principles and calculations used in the heating and cooling industry (at 240).

In some embodiments, the microprocessor-based temperature control process for controlling combustion in pellet burners 200 performs fuel delivery (at 250), whereby fuel delivery is based on the relationship of introduced BTUs, corrected mass air flow, a set point based on the difference between furnace temperature and ambient air temperature (as calculated by the data from the furnace temperature sensor/transmitter 114 minus the data from the ambient temperature sensor/transmitter 112), set efficiency, and temperature controller with 20% BTU influence for corrections of unknowns.

In some embodiments, the stack (exhaust) temperature sensor/transmitter 116 is used during the next step (at 260) of the microprocessor-based temperature control process for controlling combustion in pellet burners 200 to scrub off BTUs from the pellet box 120 and the furnace 118 to provide feedback along with derived efficiency algorithm for the fuel dosing calculations (at 260). The microprocessor-based temperature control process for controlling combustion in pellet burners 200 of some embodiments transitions to the next step (at 270) during which the ignitor 122 is utilized as long as time permits based on limits with metered fuel delivery and proper ignition times based off an algorithm utilizing temperature (temperature from the furnace temperature sensor/transmitter 114, temperature from the stack/exhaust temperature sensor/transmitter 116), opacity (as determined by the opacity meter 126), flame signal (flame signal intensity, as determined by the flame intensity transmitter 128), and time, respectfully (at 270).

In some embodiments, the microprocessor-based temperature control process for controlling combustion in pellet burners 200 continues forward to the next step (at 280) once a flame failure is detected based on the above steps for being out of limits or a user shutoff has been requested, which causes shutdown mode to be initiated (at 280). In some embodiments, a flame failure is detected when sensor readings are outside of calculated limits from the algorithm utilizing temperature, opacity, flame signal intensity, and time. In some embodiments, a request for user shutoff is made by a user switching a toggle to turn off operation of the pellet burning furnace.

Finally, the microprocessor-based temperature control process for controlling combustion in pellet burners 200 of some embodiments enters into the shutdown mode step (at 290), whereby the shutdown mode utilizes the stack (exhaust) temperature sensor/transmitter 116, the opacity meter 126 (if utilized), the flame intensity transmitter 128, and time to determine burner status and shut off all supporting equipment and sensors at a safe state. Then the microprocessor-based temperature control process for controlling combustion in pellet burners 200 ends.

To use the microprocessor-based controller for pellet burners of the present disclosure, a package system would be connected to a wood pellet combustion system. Currently most systems have trouble controlling temperature and flame stability. This has caused fires and explosions of pellet burning systems. Once the microprocessor/micro-controller 110 and its necessary sensors are connected to the desired pellet burning device, the user will interface the system with commands and set points via network through a PC, phone, PDA, or other. The microprocessor/micro-controller 110 will take the desired functions and provide sequencing to start the combustion process. The microprocessor/micro-controller 110 will monitor the process for proper function and safety.

By providing a feed forward approach to the combustion process, the microprocessor/micro-controller 110 utilizes known values of pellets, air flow, and temperature to determine the proper amount of fuel for combustion. This will more accurately control the temperature process in changing environments instead of using just temperature and time constants. Using temperature and a time control approach has led to fires and explosions that are well documented with consumer reports and internet videos and blogs.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

We claim:

1. A microprocessor-based controller for pellet burners comprising:

a plurality of temperature sensors that detect temperature;

a furnace in which temperature rises to a heat level by burning fuel;

a pellet box burner that is positioned within the furnace and is fed pellet fuel;

an ignitor that creates heat to ignite a flame to the pellet fuel in the burner;

an air flow sensor that detects air flow in the furnace;

a combustion air fan to provide air for combustion;

an opacity meter that is included for safety to control desired opacity;

a pellet auger motor to start primary ignition when interlocks between sensors and set points are satisfied by sensor readings of sensors connected to the burner and set points for the sensor readings as set through an interface by a user; and a microprocessor that is connected to the plurality of temperature sensors, the air flow sensor, the combustion air fan, the pellet auger motor, the opacity meter, and the interface through which the user provides the set points to the microprocessor.

2. The microprocessor-based controller for pellet burners of claim 1 further comprising a furnace door switch that opens and shuts to control natural draft air through the furnace.

3. The microprocessor-based controller for pellet burners of claim 1, wherein the plurality of temperature sensors comprises an ambient air temperature sensor, a furnace temperature sensor, and an exhaust temperature sensor.

4. The microprocessor-based controller for pellet burners of claim 1 further comprising a user interface device operated by the user, wherein the user interface device connects wirelessly over a network to the interface.

5. The microprocessor-based controller for pellet burners of claim 4, wherein the microprocessor is wirelessly connected to the user interface device.

6. A microprocessor-based pellet burner temperature control process comprising:

delivering fuel to an empty pellet burning burner;

setting an ignitor for primary ignition by a pellet auger motor based on fuel dosing calculations of a microprocessor that controls temperature of the pellet burning burner;

performing primary ignition by the pellet auger motor when interlocks between temperature sensors and set points are satisfied by temperature readings of the temperature sensors connected to the pellet burning burner and set points for the temperature readings as set through an interface by a user;

setting the microprocessor to operate in a feed forward control mode for the pellet burning burner;

delivering fuel and proper ignition times to the burner based on calculations of the microprocessor for an algorithm utilizing temperature measured in BTUs, opacity as determined by an opacity meter, flame signal intensity as determined by a flame intensity transmitter, corrected mass air flow as determined by an air flow sensor of the pellet burning furnace, a set point based on a difference between temperature readings of an ambient temperature sensor of the pellet burning furnace and a furnace temperature sensor of the pellet burning furnace, and efficiency control and influence factors;

using an exhaust temperature sensor of the pellet burning burner to scrub BTUs from the burner to provide data feedback that is used for fuel dosing calculations;

delivering metered fuel continuously to the burner according to the fuel dosing calculations until a shutdown event is detected by the microprocessor; and initiating shutdown mode, by the microprocessor, when the shutdown event is detected by the microprocessor.

7. The microprocessor-based pellet burner temperature control process of claim 6, wherein the delivered fuel is sufficient in amount for a set temperature point.

8. The microprocessor-based pellet burner temperature control process of claim 6, wherein the feed forward control mode is based on American Society of Heating, Refrigerating and Air-Conditioning Engineers (ASHRAE) principles and calculations used in the heating and cooling industry.

9. The microprocessor-based pellet burner temperature control process of claim 6, wherein the shutdown event is detected based on at least one of (i) a shutoff request initiated by a user switching a toggle to turn off operation of the pellet burning furnace and (ii) a detection of a flame failure.

* * * * *